US010225661B2

(12) United States Patent
Pan

(10) Patent No.: US 10,225,661 B2
(45) Date of Patent: Mar. 5, 2019

(54) LOUDSPEAKER

(71) Applicant: WISTRON CORP., New Taipei (TW)

(72) Inventor: Li-Ping Pan, New Taipei (TW)

(73) Assignee: WISTRON CORP., New Taipei (TW)

( * ) Notice: Subject to any disclaimer, the term of this patent is extended or adjusted under 35 U.S.C. 154(b) by 54 days.

(21) Appl. No.: 15/293,253

(22) Filed: Oct. 13, 2016

(65) Prior Publication Data

US 2018/0048963 A1 Feb. 15, 2018

(30) Foreign Application Priority Data

Aug. 15, 2016 (TW) ..... 105125987 A

(51) Int. Cl.

| | |
|---|---|
| ***H04R 9/00*** | (2006.01) |
| ***H04R 9/04*** | (2006.01) |
| ***H04R 9/02*** | (2006.01) |
| ***H04R 9/06*** | (2006.01) |

(52) U.S. Cl.

CPC ..... *H04R 9/045* (2013.01); *H04R 9/022* (2013.01); *H04R 9/025* (2013.01); *H04R 9/06* (2013.01); *H04R 2499/11* (2013.01)

(58) Field of Classification Search

CPC .... H04R 1/025; H04R 11/02; H04R 2400/07; H04R 9/04; H04R 9/025

See application file for complete search history.

(56) References Cited

U.S. PATENT DOCUMENTS

| | | | | |
|---|---|---|---|---|
| 3,798,391 | A * | 3/1974 | Parker | H04R 11/02 381/163 |
| 4,542,311 | A * | 9/1985 | Newman | H02K 33/16 310/13 |
| 4,626,717 | A * | 12/1986 | Hensing | H02K 33/16 310/36 |
| 5,216,723 | A * | 6/1993 | Froeschle | H04R 3/002 381/415 |
| 8,948,440 | B2 * | 2/2015 | Lin | H04R 1/02 381/412 |
| 9,100,740 | B2 * | 8/2015 | Huang | H04R 9/025 |
| 2005/0111673 | A1 * | 5/2005 | Rosen | B60R 11/0217 381/89 |
| 2005/0123166 | A1 | 6/2005 | Chen et al. | |

(Continued)

FOREIGN PATENT DOCUMENTS

| | | |
|---|---|---|
| CN | 204761697 U | 11/2015 |
| TW | 200520586 A | 6/2005 |
| WO | 2010/106674 A1 | 9/2010 |

OTHER PUBLICATIONS

TW Office Action dated Jun. 30, 2017 as received in Application No. 105125987 (English Translation).

*Primary Examiner* — Matthew A Eason
(74) *Attorney, Agent, or Firm* — Maschoff Brennan

(57) ABSTRACT

A loudspeaker includes a cavity, a first coil, a first magnet and a linking-up unit. The cavity includes a vibration film. The vibration film is disposed on an opening of the cavity. The first coil is configured to adjust a first magnetic field in the first coil according to the driving of an electronic signal. At least part of the first magnet is in the first coil. The first magnet is movable along a first axis. The linking-up unit is between the vibration film and the first magnet. The linking-up unit is connected to the vibration film and the magnet respectively.

9 Claims, 11 Drawing Sheets

(56) References Cited

U.S. PATENT DOCUMENTS

2007/0165887 A1* 7/2007 Shin ..... H04R 9/025
381/152
2009/0028371 A1* 1/2009 Bailey ..... H04R 9/025
381/386
2011/0069859 A1* 3/2011 Kobayashi ..... H04R 9/10
381/400
2011/0176703 A1* 7/2011 Horigome ..... H04R 1/2819
381/412
2011/0243365 A1* 10/2011 Carlmark ..... H04R 11/02
381/398
2011/0243366 A1* 10/2011 Carlmark ..... H04R 11/02
381/398
2012/0106772 A1* 5/2012 Horigome ..... H04R 9/06
381/398
2012/0114136 A1* 5/2012 Horigome ..... H04R 9/02
381/86
2012/0207338 A1* 8/2012 Babb ..... H04R 9/022
381/400
2014/0270328 A1* 9/2014 Lucas ..... H04R 9/027
381/400
2015/0256046 A1* 9/2015 Lucas ..... H02K 7/003
381/400
2015/0256935 A1* 9/2015 Lucas ..... H04R 7/00
381/398
2015/0256936 A1* 9/2015 Lucas ..... H04R 7/00
381/398
2015/0372580 A1* 12/2015 Lucas ..... H04R 9/027
381/418
2018/0048963 A1* 2/2018 Pan ..... H04R 9/022

* cited by examiner

LOUDSPEAKER

CROSS-REFERENCE TO RELATED APPLICATIONS

This non-provisional application claims priority under 35 U.S.C. § 119(a) on Patent Application No(s). 105125987 filed in Taiwan, R.O.C. on Aug. 15, 2016, the entire contents of which are hereby incorporated by reference.

BACKGROUND

Technical Field

This disclosure relates to a loudspeaker, and more particularly to an electrical loudspeaker.

Related Art

A loudspeaker is applicable to transforming an electronic signal to an audio signal, so it is applied to the audio related electronic device, such as phones and speakers. There are electric type, piezoelectric type, electromagnetic type, and plasma type of loudspeakers. Among these, the electric type of loudspeaker is widely used because it costs less and is manufactured more easily in comparison with the others.

Nowadays, due to the popularity of hand-held electronic devices and miniaturized electronic devices, the miniaturization of loudspeakers is a main issue. Although the piezoelectric loudspeakers and electric loudspeakers are made miniaturized in the laboratory, the costs of manufacture block the probability of the application of general consumer electronic devices for those loudspeakers. Besides, by the miniaturization of electric loudspeakers, the low frequency response of the electric loudspeakers decreases relatively. It causes damage to the performance of speakers. To increase bass output, we need to supply larger current to the coils of loudspeakers. However, the coils are generally fixed connected to the vibration film in the conventional electric loudspeakers, so the heat dissipating ability of the coils is limited and the max output current is also limited. Therefore, how to provide an electric loudspeaker applied to miniaturization is an issue to resolve.

SUMMARY

The disclosure provides a loudspeaker including a cavity, a first coil, a first magnet and a linking-up unit. The cavity has a vibration film which is disposed on the opening of the cavity. The first coil is configured to adjust the first magnetic field in the first coil according to the driving of an electronic signal. At least part of the first magnet is in the first coil, and the first magnet is movable along a first axis. The linking-up unit is disposed between the vibration film and the first magnet, and connected to the vibration film and the magnet respectively.

In another embodiment, the linking-up unit is a reed which has a first terminal, a second terminal and a bending portion. The first terminal of the reed is connected to the first inner wall of the cavity, the second terminal of the reed is connected to the first magnet, and the bending portion of the reed is connected to the vibration film.

In yet another embodiment, the loudspeaker further includes a resetting unit which has a first terminal and a second terminal. The first terminal of the resetting unit is connected to the second inner wall of the cavity, and the second terminal of the resetting unit is connected to the first magnet.

In yet another embodiment, the loudspeaker further includes a second coil and a second magnet. The second coil is configured to adjust a second magnetic field in the second coil according to a driving of an electronic signal. Besides, at least part of the second magnet is in the second coil, and the second magnet is movable along a first axis. The linking-up unit is a reed which has a first terminal, a second terminal and a bending portion. The first terminal of the reed is connected to the first magnet, the second terminal of the reed is connected to the second magnet, and the bending portion of the reed is connected to the vibration film.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
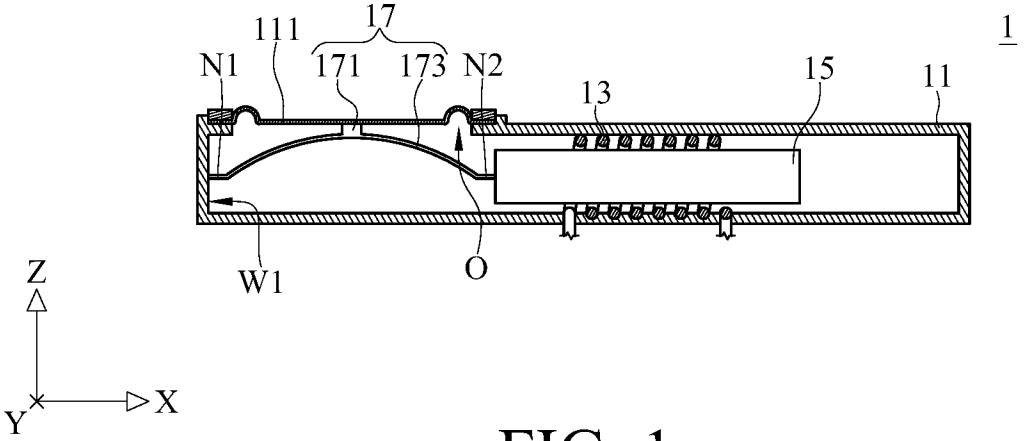
FIG. 1 is a schematic diagram of a structure of a loudspeaker in an embodiment.

Please refer to FIG. 1, which is a schematic diagram of a structure of a loudspeaker in an embodiment of the disclosure. As shown in FIG. 1, the loudspeaker 1 has a cavity 11, a first coil 13, a first magnet 15 and a linking-up unit 17. The cavity 11 has a vibration film 111 which is disposed on the opening O of the cavity 11. At least part of the vibration film 111 is exposed to the opening O of the cavity 11. At least part of the first magnet 15 is in the first coil 13 and the first magnet 15 is movable along x axis. The linking-up unit 17 is between the vibration film 111 and the first magnet 15 and connected to the vibration film 111 and the first magnet 15 respectively. In an embodiment, the linking-up unit 17 is connected to the vibration film 111 via the connection point 171.

The first coil 13 adjusts the first magnetic field of the first coil 13 according to the driving of an electronic signal. In an embodiment, the first coil 13 is electrically connected to the driving circuit of system, and receives the electronic signal from the driving circuit of system. The electronic signal contains the data related to the audio which is to output. According to Biot-Savart Law, when the direction, the value, or the phase of the current of the electronic signal changes, the direction or the value of the magnetic field of the first coil 13 also changes. In other words, the change in the magnetic field of the first coil 13 according to the electronic signal represents that the magnetic field of the first coil 13 implicitly contains the data related to the electronic signal, which means the data related to the audio to output. Person having ordinary skill in the art can design the related details based on this specification, so the related details are not described here.

As FIG. 1 and the structure of the loudspeaker 1 described above, when the magnetic field of the first coil 13 changes, the first magnet 15 moves along x axis due to the influence of the magnetic field of the first coil 13. Following the first magnet 15 moving along x axis, the connection point 171 of the linking-up unit 17 also moves along z axis and leads to the vibration film 111 moving along z axis. The disclosure does not intend to limit the direction of the magnetic field of the first magnet 15. The shape of the first magnet 15, for example, flat rodlike or cylindrical, is not limited in the disclosure.

More specifically, in the embodiment shown in FIG. 1, the linking-up unit 17 is a reed which has a first terminal N1, a second terminal N2 and a bending portion 173. The first terminal N1 of the reed is connected to the first inner wall W1 of the cavity 11. The second terminal N2 of the reed is connected to the first magnet 15. The bending portion 173 of the reed is connected to the vibration film 111 via the connection point 171. When the first magnet 15 moves along x axis, the first magnet 15 presses or pulls the reed. As a result, the bending portion 173 deformed is followed by the connection point 171 moves along z axis. In other words, when the change in the magnetic field of the first coil 13 leads to the result that the first magnet 15 presses the linking-up unit, the connection point 171 moves along z axis to the external part and the vibration film 111 moves along z axis to the external cavity 11. On the other hand, when the change in the magnetic field of the first coil 13 leads to the result that the first magnet 15 pulls the linking-up unit, the connection point 171 moves along z axis to the internal part and the vibration film 111 moves along z axis to the internal cavity 11. Therefore, the vibration film 111 is capable of moving backwards and forwards selectively along z axis. Because the magnetic field of the first coil 13 contains the data related to the electronic signal, the vibration film 111 moves backwards and forwards along z axis according to the data related to the electronic signal and then output the audio.

Figure 2:
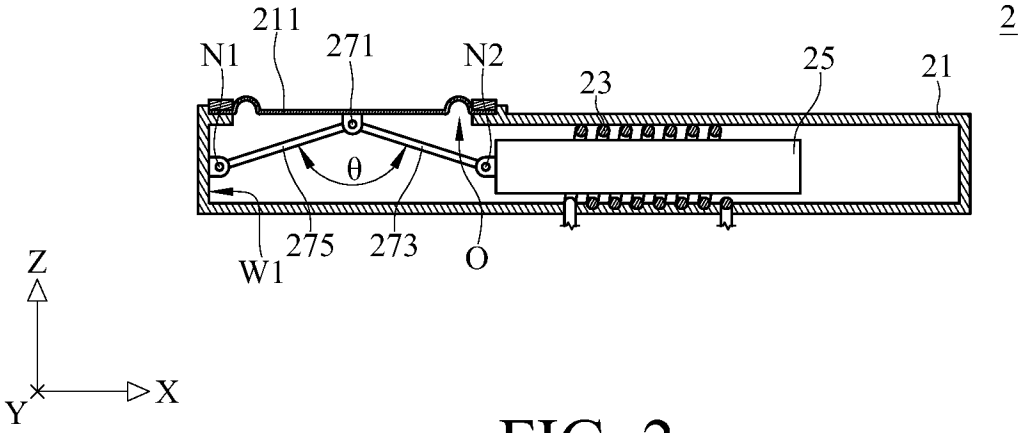
FIG. 2 is a schematic diagram of a structure of a loudspeaker in another embodiment.

Please refer to FIG. 2, which is a schematic diagram of a structure of a loudspeaker in another embodiment. As shown in FIG. 2, the structure of the loudspeaker 2 is approximately similar to the structure of the loudspeaker 1 in FIG. 1, so the related details are not described again. In this embodiment, the linking-up unit 27 is a linking rod as an example. More specifically, the linking-up unit 27 has a first connector 273 and a second connector 275 which are connected to the connection point 271. The linking-up unit 27 is connected to the vibration film 211 via the connection point 271. A variable included angle θ is between the first connector 273 and the second connector 275. When the first magnet 25 presses the linking-up unit 27 because of the change in the magnetic field of the first coil 23, the included angle θ becomes smaller, the connection point 271 moves along z axis to the external cavity 21, and the vibration film 211 moves along z axis to the external cavity 21 (i.e. moves to the positive direction of z axis). On the other hands, when the first magnet 25 pulls the linking-up unit 27 because of the change in the magnetic field of the first coil 23, the included angle θ becomes larger, the connection point 271 moves along z axis to the internal cavity 21, and the vibration film 211 moves along z axis to the internal cavity 21. Therefore, the vibration film 211 is capable of moving backwards and forwards selectively along z axis. Moreover, the vibration film 211 moves backwards and forwards along z axis according to the data related to the electronic signal and then output the audio.

Figure 3:
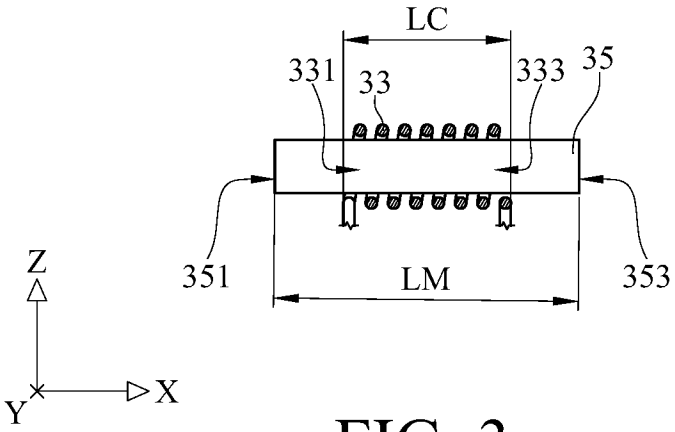
FIG. 3 is a schematic diagram of the relative position of the first coil and the first magnet in an embodiment.

Please refer to FIG. 3, a schematic diagram of the relative position of the first coil and the first magnet in an embodiment. As shown in FIG. 3, the first magnet 35 has a first polar terminal 351 and a second polar terminal 353. The length of magnet LM is defined as the distance between the first polar terminal 351 and the second polar terminal 353. Besides, the first coil 33 has a first opening 331 and a second opening 333. The length of first coil LC is defined as the distance between the first opening 331 and the second opening 333. The length of first coil LC is different the length of magnet LM. In this embodiment, the length of first coil LC is less than the length of magnet LM. When the first magnet 35 moves backwards and forwards along x axis, the first polar terminal 351 and the second polar terminal 353 of the first magnet 35 are always outside the coil. In other words, when the first magnet 35 moves backwards and forwards, two terminals of the first magnet 35 consistently keep outside the first coil 33. As a result, the relative state between the first magnet 35 and the first coil 33 is consistent.

In another embodiment, the length of first coil LC is longer than the length of magnet LM. When the first magnet 35 moves backwards and forwards along x axis, the first polar terminal 351 and the second polar terminal 353 of the first magnet 35 are always inside the coil. In other words, when the first magnet 35 moves backwards and forwards, two terminals of the first magnet 35 consistently keep inside the first coil 33. As a result, the relative state between the first magnet 35 and the first coil 33 is consistent. The change in the relative state between a magnet and a coil according to the current of the coil easily results in the total harmonic distortion (THD) of the audio which is sent out.

Figure 4:
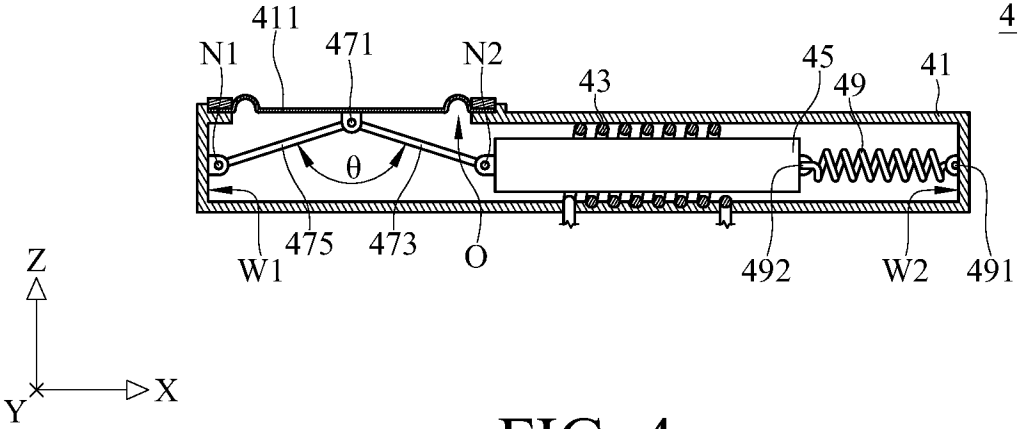
FIG. 4 is a schematic diagram of a structure of a loudspeaker in yet another embodiment.

Please refer to FIG. 4, which is a schematic diagram of a structure of a loudspeaker in yet another embodiment. As shown in FIG. 4, the structure of the loudspeaker 4 is approximately similar to the structure of the loudspeaker 1 in the FIG. 1 or the loudspeaker 2 in FIG. 2. In the embodiment shown in FIG. 4, the loudspeaker 4 further has a resetting unit 49, which has a first terminal 491 and a second terminal 492. The first terminal 491 of the resetting unit 49 is connected to the second inner wall W2 of the cavity 11 and the second terminal 492 of the resetting unit 49 is connected to the first magnet 45. The resetting unit 49 is used for making the first magnet 45 back to the original position. More specifically, when the first magnet 45 presses the linking-up unit 47 as described above, the first magnet 45 is close to the first inner wall W1 but the second inner wall W2. Then, the resetting unit 49 exerts an equivalent tensile force to the first magnet 45 to make the resetting unit 49 back to the original position. Similarly, when the first magnet 45 pulls the linking-up unit 47 as described above, the first magnet 45 is close to the second inner wall W2 but the first inner wall W1. Then, the resetting unit 49 exerts an equivalent thrust force to make the resetting unit 49 back to the original position.

In an embodiment, the resetting unit 49 is a spring as an example. There might be a simple harmonic motion during the first magnet 45 back to the original position due to the resetting unit 49. Furthermore, because of magnetic field, the resetting unit 49 might press or pull the first magnet 45 during the first magnet 45 back to the original position. However, as an equivalent result, the resetting unit 49 exerts an equivalent thrust force or tensile force to the first magnet 45 to make the first magnet 45 back to the original position. Person having ordinary skill in the art can get the related details based on this specification and figures, so the related details are not described here.

Figure 5:
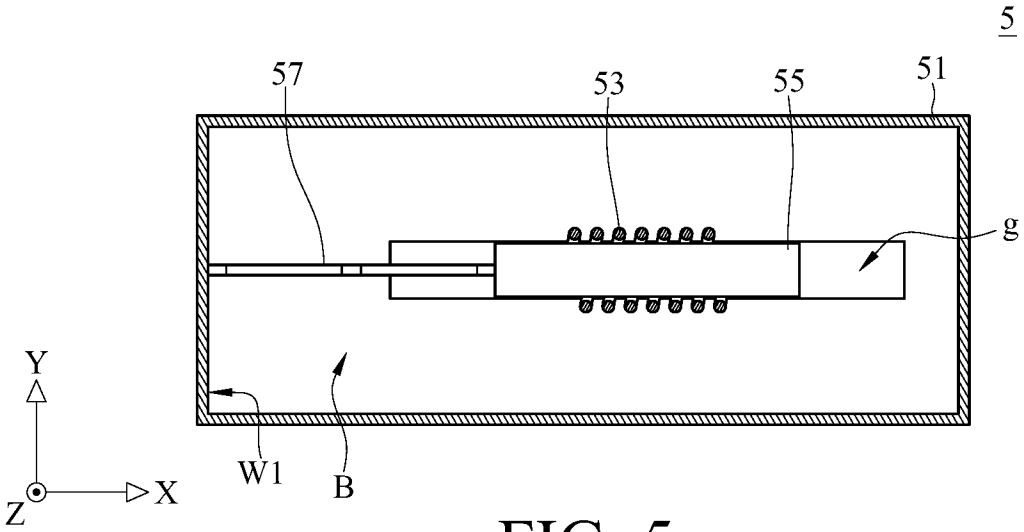
FIG. 5 is a top view of the structure of the loudspeaker in yet another embodiment.

Please refer to FIG. 5, which is a top view of the structure of the loudspeaker in yet another embodiment. As shown in FIG. 5, the cavity 51 further has an inner chute structure g and first magnet 55 is movable along the chute structure g. In an embodiment, the cavity 51 has a bottom B and a chute, as the chute structure g, is disposed at bottom B. The first magnet 55 is disposed at the chute structure g. The first magnet 55 is disposed at the bottom of the chute as an example and slides at the bottom of the chute. As another example, a sliding panel is movably disposed at the bottom of the chute structure g (not shown in figure) and the first magnet 55 is loaded on the sliding panel. In another embodiment, the chute structure g is constructed as a rail to make the first magnet 55 move backwards and forwards along the rail.

Figure 6:
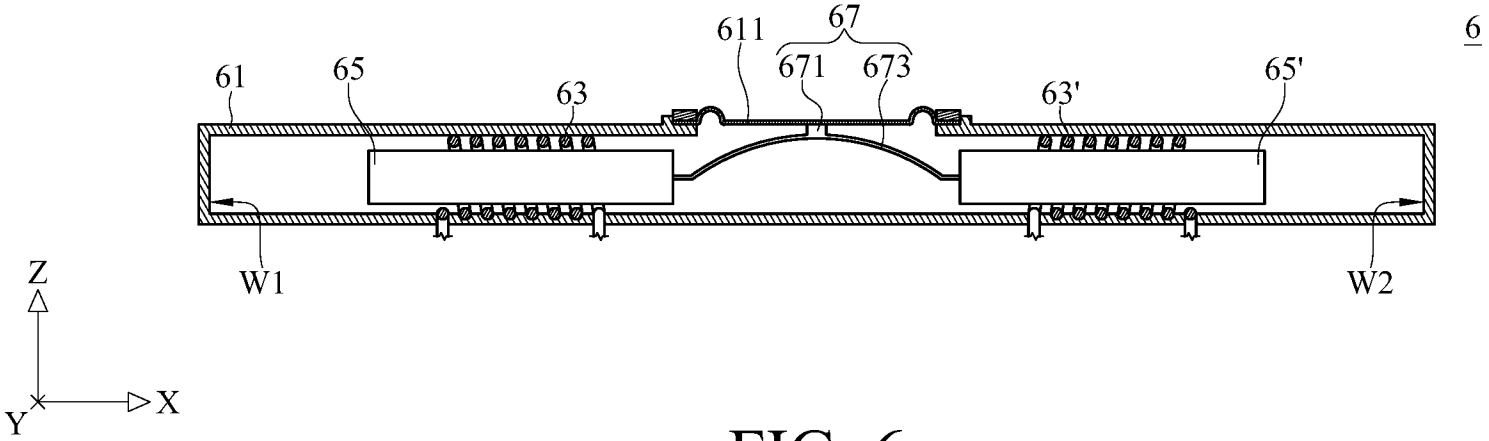
FIG. 6 is a schematic diagram of a structure of a loudspeaker in yet another embodiment.

Please refer to FIG. 6, a schematic diagram of a structure of a loudspeaker in yet another embodiment. As shown in FIG. 6, the loudspeaker 6 further has a second magnet 65' and a second coil 63'. At least part of the second magnet 65' is disposed in the second coil 63' and the second magnet 65' is movable along x axis. The second coil 63' adjusts the second magnetic field of the second coil 63' according to the electronic signal and the related details like described above are not described again. Whether the electronic signal received by the first coil 63 and the electronic signal received by the second coil 63' are same or different is not limited. Besides, in this embodiment, the linking-up unit 67 is a reed which has a connection point 671 and a bending portion 673. One terminal of the reed is connected to the first magnet 65 and the other terminal of the reed is connected to the second magnet 65'. The bending portion 673 of the reed is connected to the vibration film 611 via the connection point 671. The related details about the first coil 63 and second coil 63' changing the magnetic field according to the electronic signal to make the first magnet 65 and the second magnet 65' move along x axis via the linking-up unit 67 and then make the vibration film 611 moves along z axis are as the above description and not described again. In an embodiment, the direction of the magnetic field of the first magnet 65 is same as the direction of the magnetic field of the second magnet 65' to avoid the weakening of the magnetism of the first magnet 65 and the second magnet 65'. However, this disclosure does not intend to limit the direction of the magnetic field. In an embodiment, controlling the signal received by the first coil 63 and the signal received by the second coil 63' makes the second magnet 65' move along the negative direction of x axis and the first magnet 65 moves along the positive direction of x axis at the same time. Similarly, the second magnet 65' moves along the negative direction of x axis when the first magnet 65 moves along the positive direction of x axis.

Figure 7:
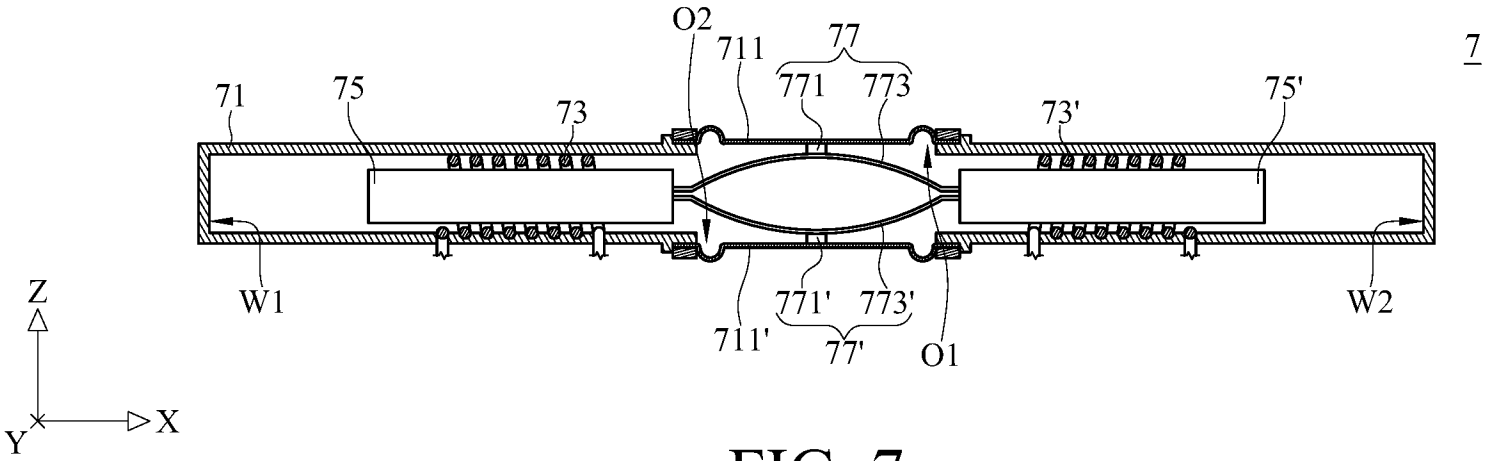
FIG. 7 is a schematic diagram of a structure of a loudspeaker in yet another embodiment.

Please refer to FIG. 7, a schematic diagram of a structure of a loudspeaker in yet another embodiment. As shown in FIG. 7, the cavity 71 of the loudspeaker 7 further has a vibration film 711'. More specifically, the loudspeaker 7 has a opposite pair of openings, the opening O1 and the opening O2. The vibration film 711 is disposed on the opening O1 and the vibration film 711' is disposed on the opening O2. At least part of the vibration film 711 is exposed to the opening O1 and at least part of the vibration film 711' is exposed to the opening O2. Besides, the loudspeaker 7 further has a linking-up unit 77' which is a reed and has a connection point 771' and a bending portion 773'. One terminal of the linking-up unit 77' is connected to the first magnet 75 and the other terminal of the linking-up unit 77' is connected to the second magnet 75'. The bending portion 773' of the linking-up unit 77' is connected to the vibration film 711' via the connection point 771'. The related details about the first coil 73 and second coil 73' changing the magnetic field according to the electronic signal to make the first magnet 75 and the second magnet 75' move along x axis and then make the vibration film 711 moves along z axis via the linking-up unit 77 and the linking-up unit 77' are as the above description and not described again.

Figure 8:
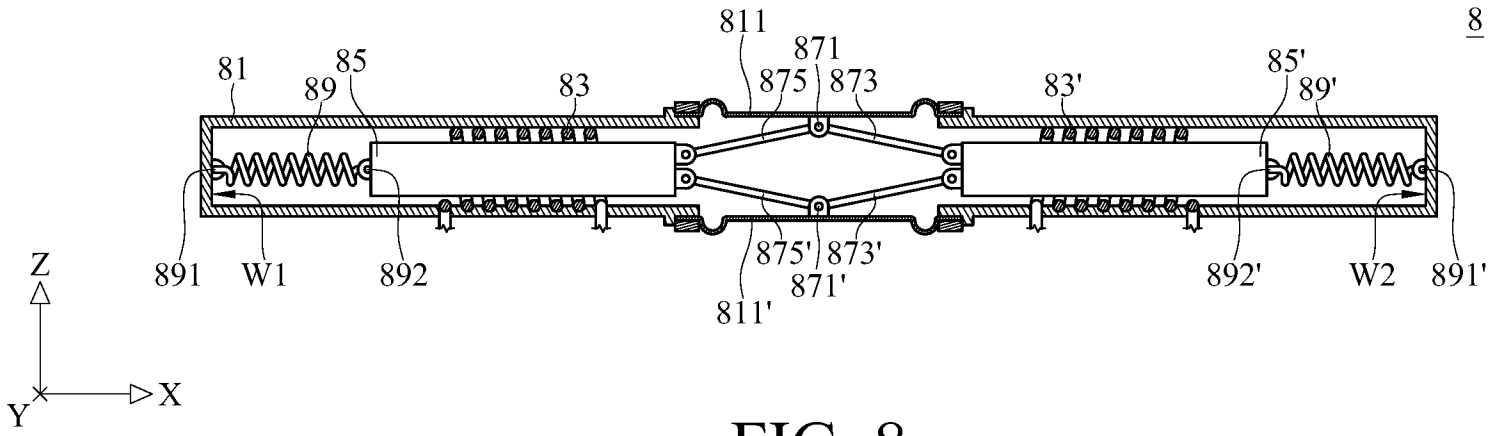
FIG. 8 is a schematic diagram of a structure of a loudspeaker in yet another embodiment.

Please refer to FIG. 8, a schematic diagram of a structure of a loudspeaker in yet another embodiment. As shown in FIG. 8, the structure of the loudspeaker 8 is approximately similar to the structure of the loudspeaker 7 in FIG. 7, so the related details are not described again. In this embodiment, the loudspeaker 8 further has a resetting unit 89 and a resetting unit 89'. The resetting unit 89 has a first terminal 891 and a second terminal 892. The first terminal 891 of the resetting unit 89 is connected to the first inner wall W1 of the cavity 81 and the second terminal 892 of the resetting unit 89 is connected to the first magnet 85. The resetting unit 89' has a first terminal 891' and a second terminal 892'. The first terminal 891' of the resetting unit 89' is connected to the second inner wall W2 of the cavity 81 and the second terminal 892' of the resetting unit 89' is connected to the second magnet 85'. The resetting unit 89 and the resetting unit 89' are used as described before to make the first magnet 85 and the second magnet 85' back to the original positions, so the related details are not described again.

Figure 9:
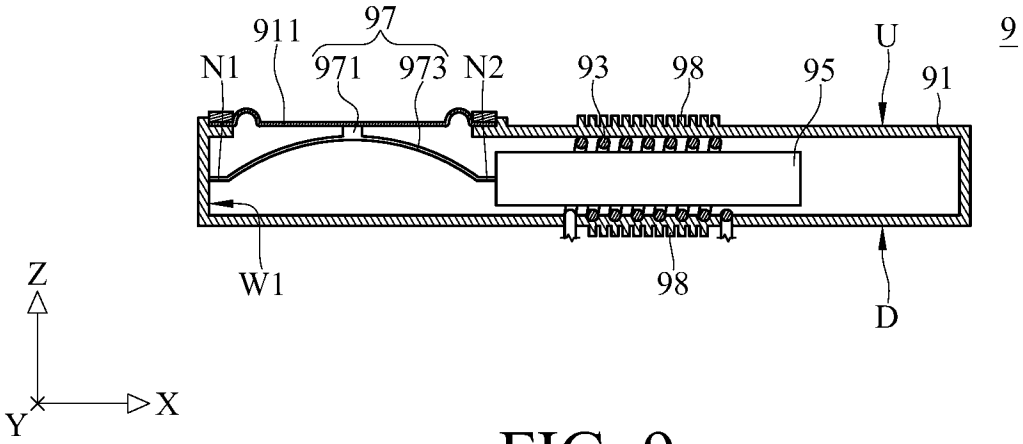
FIG. 9 is a schematic diagram of a structure of a loudspeaker in yet another embodiment.

Please refer to FIG. 9, a schematic diagram of a structure of a loudspeaker in yet another embodiment. As shown in FIG. 9, the structure of the loudspeaker 9 is approximately similar to the structure of the loudspeaker 8 shown in FIG. 8, so the related details are not described again. In this embodiment, the loudspeaker 9 further includes the heat dissipating structure 98 which is connected to the first coil 93. In an embodiment, the cavity 91 of the loudspeaker 9 is made up of the upper chassis U and the lower chassis D as an example. The heat dissipating structure 98 is disposed at the upper chassis U or the lower chassis D as an example. In another embodiment, the upper chassis U or the lower chassis D further expose the heat dissipating structure. Hence, the first coil 93 is capable of dissipating heat outward via the heat dissipating structure. The heat dissipating structure 98 is a set of cooling fin as an example or made up of the material with great thermal conductivity. According to this embodiment, person having ordinary skill in the art can know how to dispose the heat dissipating structure in another embodiment in this disclosure, so the related details are not described again.

Figure 10:
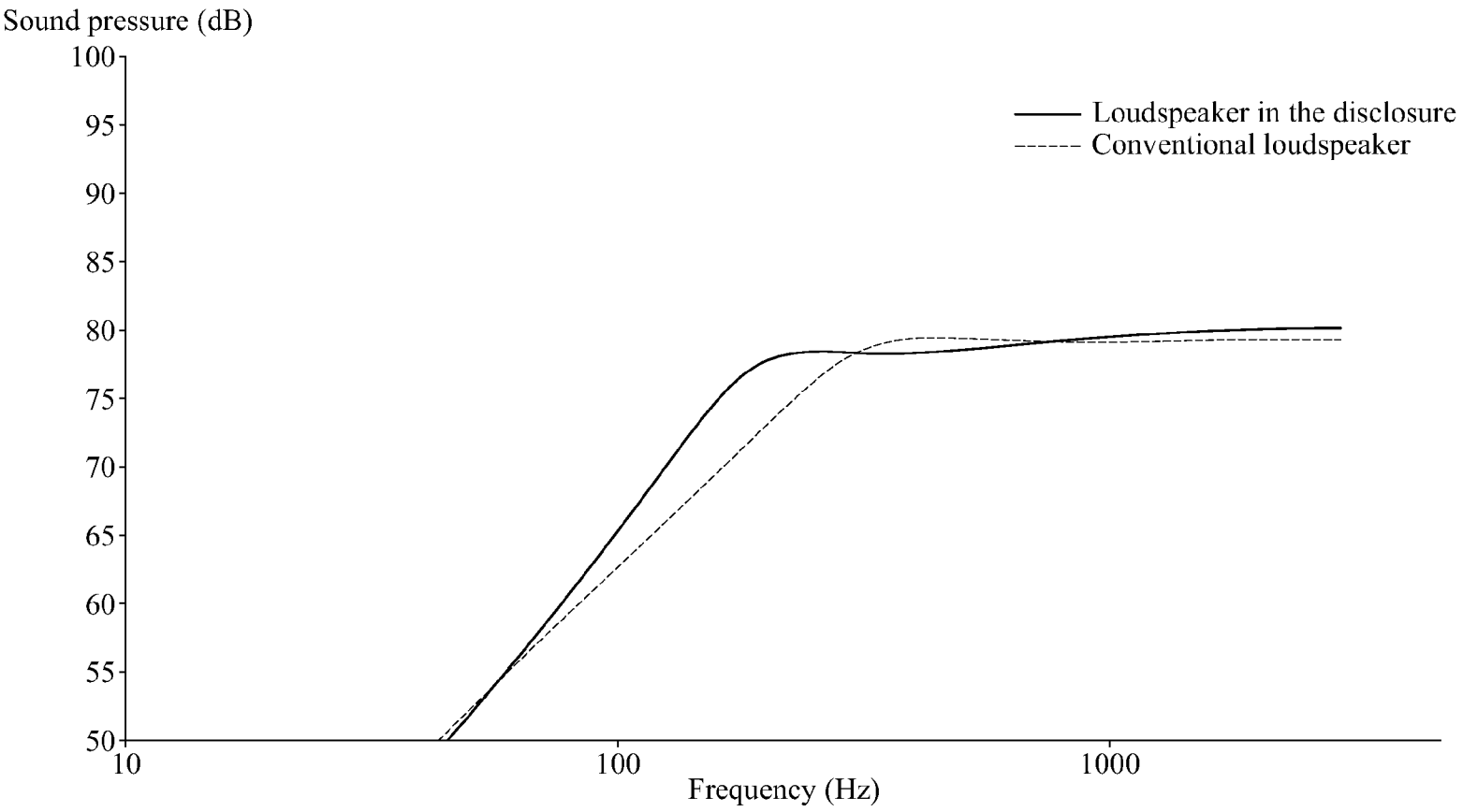
FIG. 10 illustrates a frequency response of the loudspeaker in an embodiment.
Figure 11:
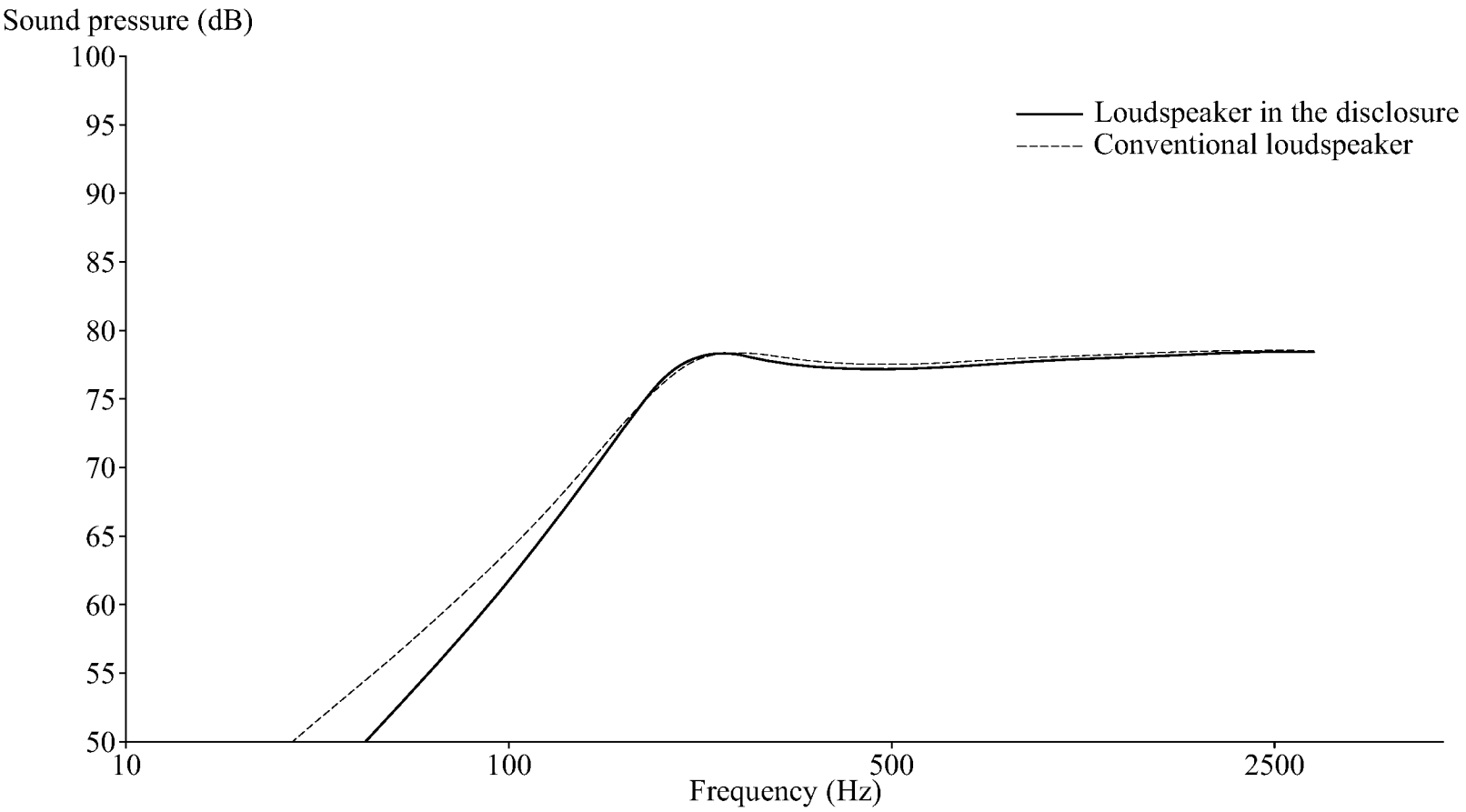
FIG. 11 illustrates a frequency response of the loudspeaker in another embodiment.

Based on the structure described in the above embodiments in the disclosure, the coil with more turns is used for increasing the upper limit of the current flowing through the coil and then increasing the magnetic parameter (Bl) of the loudspeaker. Moreover, the magnet becomes a part of the mass loading of the vibration film moving and then the parameter of vibrating mass (Mms) increases. Although the vibrating mass Mms, which includes the mass of the magnet, the coil and other units involved in vibration, increases, Bl also increases so that the sound pressure level (SPL) remains consistent. Besides, with the structure in the aforementioned embodiments, the SPL curve extends to low frequency more than the conventional structure. Please refer to FIG. 10 and FIG. 11 for explaining the function of the loudspeaker in the disclosure. FIG. 10 illustrates a frequency response of the loudspeaker in an embodiment and FIG. 11 illustrates a frequency response of the loudspeaker in another embodiment. In the embodiments shown in FIG. 10 and FIG. 11, the loudspeaker as shown in FIG. 1 is applied to all in one (AIO) computer. Also, the related measurement result of the loudspeaker in the disclosure is compared with the measurement result of the conventional loudspeaker which is applied to the same environment.

Please refer to following FIG. 10, the following table shows that the parameters of the loudspeaker in the disclosure are apparently better than the parameters of the conventional loudspeaker. As shown in FIG. 10, in comparison with conventional loudspeakers, the loudspeaker in the disclosure apparently has wider bandwidth with the same effective volume.

| Parameter (unit) | Loudspeaker provided in the disclosure | Conventional loudspeaker |
|---|---|---|
| Bl (Tm) | 3.00 | 1.00 |
| Mms (g) | 2.7 | 1.0 |
| Vas (liter) | 0.3 | 0.3 |
| Cs (mm/N) | 1.00 | 1.00 |
| fs (Hz) | 96.86 | 159.15 |
| max SPL (dB/(V/m)) | 80.21/2.83 | 79.41/2.83 |

In the above table, Bl is a magnetic parameter, Mms is the parameter of vibrating mass, Vas is the parameter of effective volume parameter, Cs is the parameter of mechanical compliance, fs is the parameter of resonant frequency and SPL is the parameter of acoustic pressure. Person having ordinary skill in the art know the definitions of the parameters described above, so the definitions are not described again. More specifically, in comparison with conventional loudspeakers, the loudspeaker in the disclosure has a larger max SPL and lower resonant frequency with the same effective volume. As shown in FIG. 10, the loudspeaker in the disclosure performs apparently better than conventional loudspeakers do in low frequency. The attenuation frequency of the loudspeaker in the disclosure is apparently lower than the attenuation frequency of the conventional loudspeaker in the response curve diagram.

Please refer to following table and FIG. 11. As shown in the following table and FIG. 11, when the effective volume of the loudspeaker in the disclosure decreases, the response curve of the loudspeaker in the disclosure has no obvious difference from the response curve of the loudspeaker. In other words, with less effective volume, the loudspeaker in the disclosure has the same efficiency as the conventional loudspeaker.

| Parameter (Unit) | Loudspeaker provided in the disclosure | Conventional loudspeaker |
|---|---|---|
| Bl (Tm) | 3.00 | 1.00 |
| Mms (g) | 3.0 | 1.0 |
| Vas (liter) | 0.1 | 0.3 |
| Cs (mm/N) | 0.25 | 1.00 |
| fs (Hz) | 183.78 | 129.95 |
| max SPL (dB/(V/m)) | 78.45/2.83 | 78.53/2.83 |

In the above table, Bl is a magnetic parameter, Mms is the parameter of vibrating mass, Vas is the parameter of effective volume parameter, Cs is the parameter of mechanical compliance, fs is the parameter of resonant frequency and SPL is the parameter of acoustic pressure. Person having ordinary skill in the art know the definitions of the parameters described above, so the definitions are not described again. More specifically, the effective volume Vas of the loudspeaker in the disclosure just has to be one third of the Vas of conventional loudspeakers to have the same max SPL as the conventional loudspeaker has. Therefore, the purpose of device miniaturization is achieved.

In view of the above description, the loudspeaker in the disclosure makes the movement along the first direction linked up with the movement along the second direction via a linking-up unit. The problem of the insufficient stroke of a vibration film is solved. Moreover, via the structure described above, the loudspeaker in the disclosure is capable of using the coil with more turns and increasing the upper limit of the current flowing through the coil to increase the magnetic force provided by the coil. As shown in the response curve described above, the loudspeaker in the disclosure is also capable of reducing the use of effective volume or enhancing the efficiency of low frequency response with the same size of effective volume. In other words, the loudspeaker in the disclosure breaks through the limitations of the conventional loudspeakers, and has better efficiency and practicability.

While this disclosure is described in terms of several embodiments above, these embodiments do not intend to limit this disclosure. It is therefore intended that the following appended claims be interpreted as including all such alterations, permutations, and equivalents as fall within the true spirit and scope of the present disclosure.

What is claimed is:

1. A loudspeaker, comprising:

a cavity having a vibration film disposed on an opening of the cavity;

a first coil configured to adjust a first magnetic field in the first coil according to a driving of an electronic signal;

a first magnet wherein at least part of the first magnet is in the first coil, and the first magnet is movable along a first axis; and a linking-up unit having a first terminal, a second terminal and a bending point comprising a third point disposed between the first and second terminals, with the first terminal connected to a first inner wall of the cavity, the second terminal connected to the first magnet and the bending point connected to the vibration film;

wherein a direction of vibration of vibration film is different from a direction of the first axis.

2. The loudspeaker according to claim 1, wherein a length of magnet is defined as a distance between a first polar terminal of the first magnet and a second polar terminal of the first magnet, a length of first coil is defined as a distance between a first opening of the first coil and a second opening of the first coil, and the length of first coil is different from the length of magnet.

3. The loudspeaker according to claim 2, wherein the length of first coil is less than the length of magnet.

4. The loudspeaker according to claim 1, wherein the linking-up unit is a reed, the reed has a first terminal, a second terminal and a bending portion, the first terminal of the reed is connected to a first inner wall of the cavity, the second terminal of the reed is connected to the first magnet, and the bending portion of the reed is connected to the vibration film.

5. The loudspeaker according to claim 1, further comprising a resetting unit, wherein the resetting unit has a first terminal and a second terminal, the first terminal of the resetting unit is connected to a second inner wall of the cavity, and the second terminal of the resetting unit is connected to the first magnet.

6. The loudspeaker according to claim 1, wherein the cavity has a inner chute structure, and the first magnet is movable along the chute structure.

7. The loudspeaker according to claim 1, further comprising:

a second coil configured to adjust a second magnetic field in the second coil according to a driving of an electronic signal; and a second magnet wherein at least part of the second magnet is in the second coil, and the second magnet is movable along a first axis;

wherein the linking-up unit is a reed, the reed has a first terminal, a second terminal and a bending portion, the first terminal of the reed is connected to the first magnet, the second terminal of the reed is connected to the second magnet, and the bending portion of the reed is connected to the vibration film.

8. The loudspeaker according to claim 7, wherein a direction of the first magnetic field of the first magnet is same as a direction of the second magnetic field of the second magnet.

9. The loudspeaker according claim 1, further comprising a heat dissipating structure connected to the first coil.

* * * * *